United States Patent [19]

Woolslayer et al.

[11] 3,986,618

[45] Oct. 19, 1976

[54] PIPE RACK WITH PIVOTED FINGERS AND SCREW CONVEYORS

[75] Inventors: Joseph R. Woolslayer; Cecil Jenkins; Lester E. Hilfiger, all of Tulsa, Okla.

[73] Assignee: Lee C. Moore Corporation, Tulsa, Okla.

[22] Filed: Sept. 5, 1975

[21] Appl. No.: 610,665

[52] U.S. Cl. ..... 214/1 PB; 214/2.5; 221/224

[51] Int. Cl.[2] ..... E21B 19/14

[58] Field of Search ..... 214/2.5, 1 P, 1 PB, 214/DIG. 3; 221/79, 103, 224, 236; 175/52, 85; 211/60 S

[56] References Cited

UNITED STATES PATENTS

| | | | |
|---|---|---|---|
| 3,630,392 | 12/1971 | Cintract | 214/2.5 X |
| 3,844,420 | 10/1974 | Walling | 214/2.5 X |

*Primary Examiner*—Robert J. Spar
*Assistant Examiner*—George F. Abraham
*Attorney, Agent, or Firm*—Brown, Murray, Flick & Peckham

[57] ABSTRACT

A plurality of vertically spaced rows of longitudinally inclined fingers spaced laterally in each row are pivotally supported on transverse horizontal axes near one end. The fingers slope upwardly from the supporting means and also project in the opposite direction from said axes. Vertically movable cam members at the lower ends of the fingers are provided with vertical surfaces that overlie the lower ends of the fingers when the cam members are in their uppermost position. The cam members are movable downwardly step by step by reversible means to cause them to depress the lower ends of the fingers and thereby raise their upper ends. The upper ends of the fingers in the row immediately below the lowest row of raised fingers are positioned to receive a horizontal pipestand lowered onto them. Inclined conveyor screws spaced laterally from the fingers and sloping to the same extent are movable vertically with the cam members. The screws are driven from their lower ends intermittently to convey each successive pipestand step by step downwardly along the fingers supporting it. When a row of fingers has been covered by a row of pipestands, the cam members are moved upwardly far enough to permit the lowest row of raised fingers to swing down over the pipes directly below ready to receive and support the next row of pipes.

10 Claims, 6 Drawing Figures

43
13
44
4
5
40
3
31
14
26
47
36
20
9
35
18
37
13
50
11
29
22
19
12
10
23
15
27
6
30
7
41
8
34
45
32
33

PIPE RACK WITH PIVOTED FINGERS AND SCREW CONVEYORS

In our copending patent application Ser. No. 585,775, filed June 11, 1975, means are shown for gripping a vertical pipestand that has been pulled out of the well and then swinging it forward and down into horizontal position onto a pipe rack. In going into the well, this sequence of operations is reversed.

It is an object of this invention to provide a pipe rack for storing a pipe horizontally in front of an oil well derrick and from which pipe can be lifted and then carried up into upright position inside the derrick in the general manner disclosed in said copending application for example. Other objects are to provide such a rack in which pipe can be quickly racked and from which pipe can be quickly removed, and which is relatively simple in operation.

The preferred emobodiment of the invention is illustrated in the accompanying drawings, in which FIG. 1 is a plan view;

Figure 1:
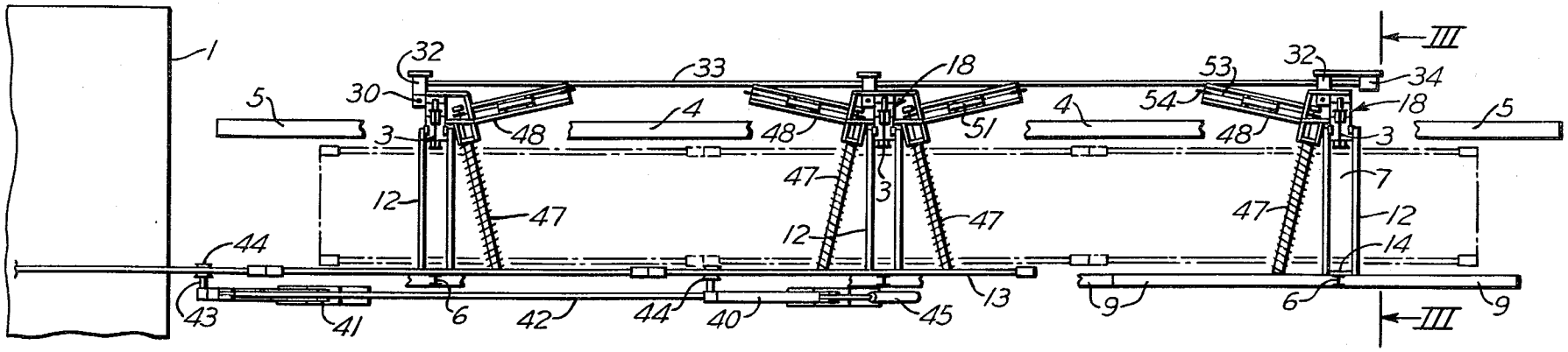
Figure 2:
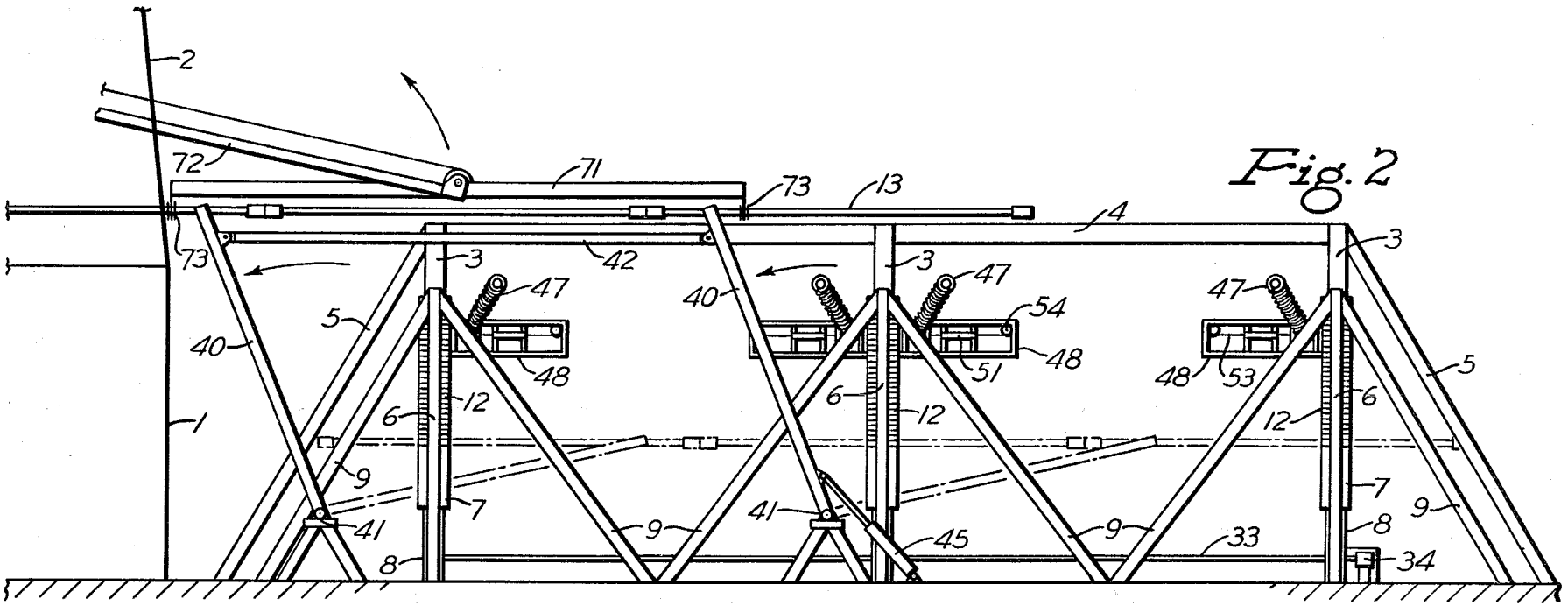
FIG. 2 is a side view.

Referring to FIGS. 1 and 2 of the drawings, a pipe rack is located in front of a substructure 1 that supports an oil well drilling derrick 2 or drilling mast. The rack is especially suitable for ships where space is limited. The rack includes a plurality of laterally spaced posts 3, three being shown. These posts are disposed in a row extending away from the front of the derrick. They are connected at their upper ends by horizontal beams 4, and the end posts are braced by inclined braces 5. Each post is in the form of an I-beam. Beside each of these posts is a shorter post 6. The shorter posts are disposed in a row close to but at the opposite side of a vertical plane parallel to the row of taller posts 3 and extending through the axis of the well. The lower portion of each of the shorter posts is connected to the taller post beside it by means of a cross beam 7 sloping downwardly toward the taller post. Beneath this beam there is a brace 8 inclined in the opposite direction. Also, inclined braces 9 are connected to the upper ends of posts 6.

Figure 3:
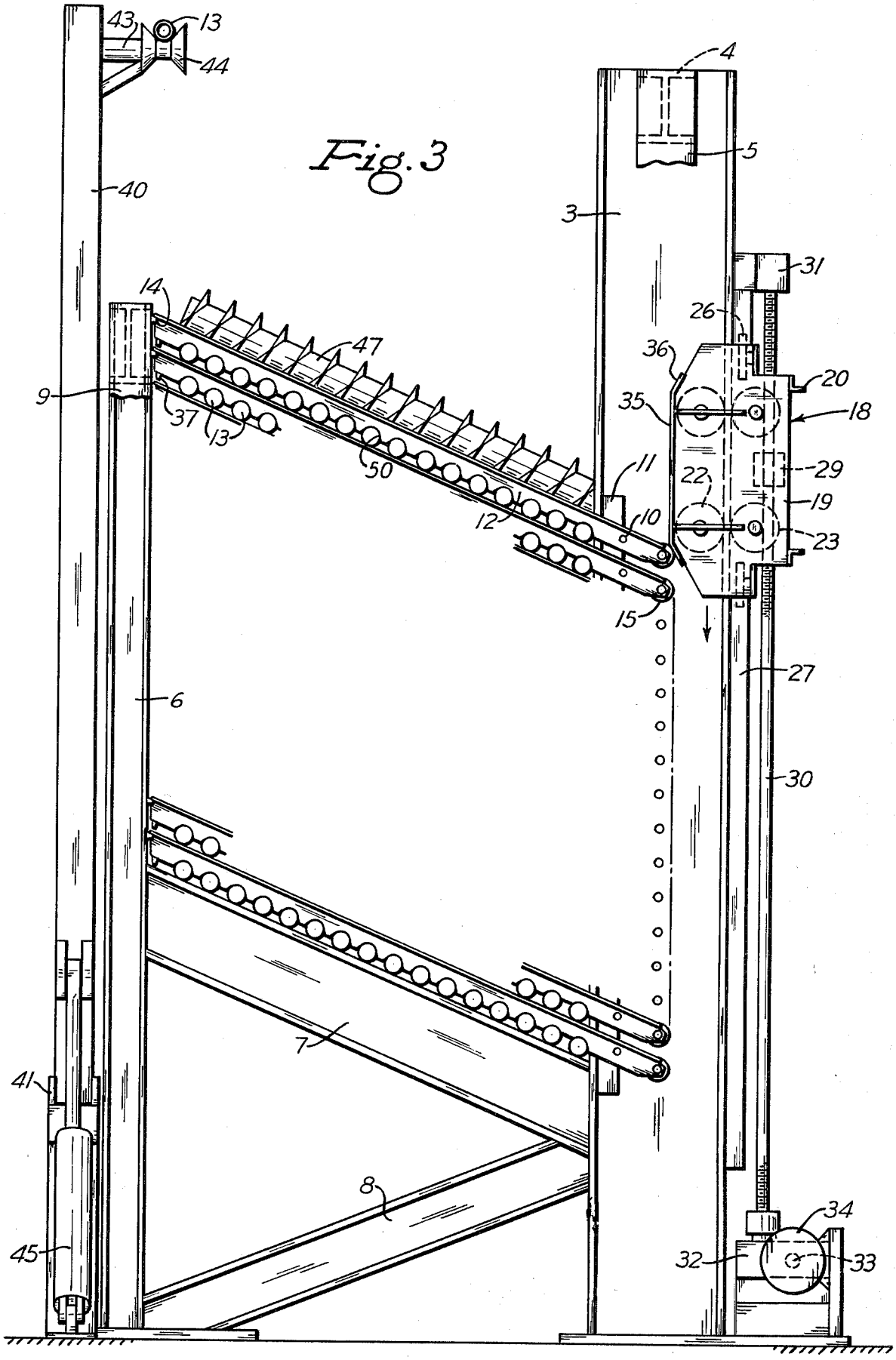
FIG. 3 is an enlarged end view taken on the line III—III of FIG. 1.
Figure 4:
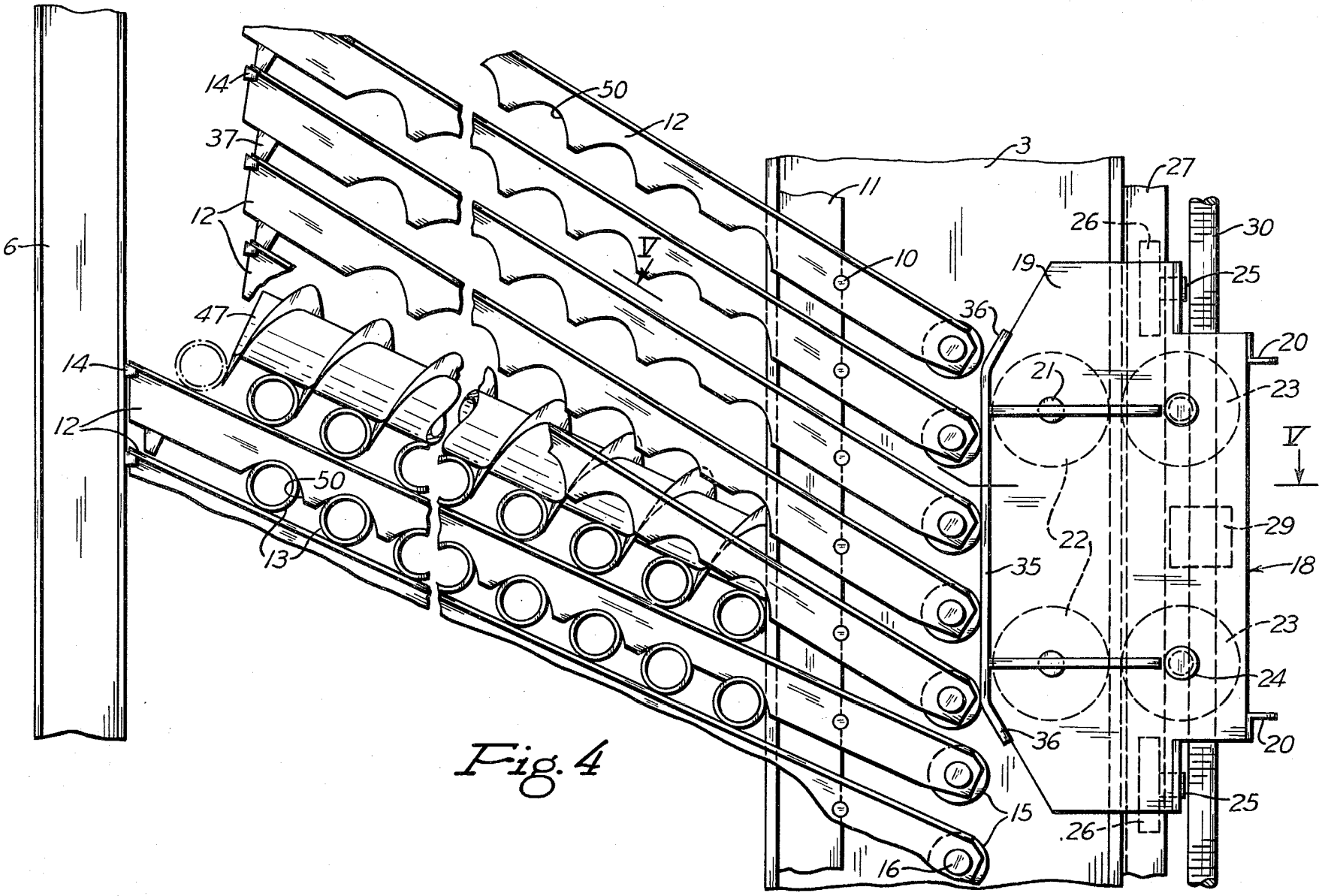
FIG. 4 is a further enlarged detail of FIG. 3, but showing some of the pivoted fingers raised.
Figures 5, 6:
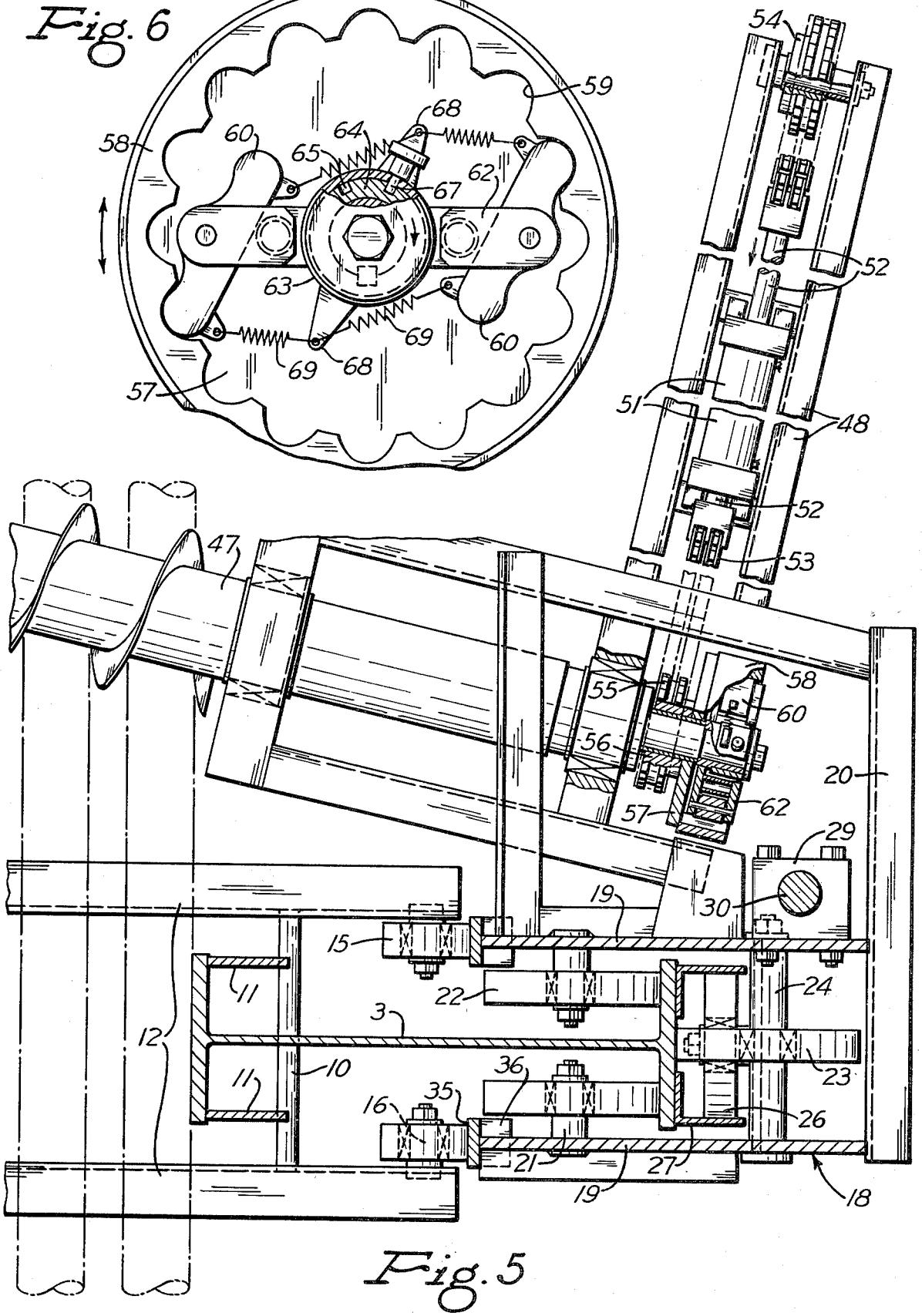
FIG. 5 is a fragmentary generally horizontal section taken on the line V—V of FIG. 4.
FIG. 6 is an enlarged side view of a conveyor screw driving and reversing device.

Extending through the web of each taller post near its inner flange is a plurality of vertically spaced horizontal pivot pins 10, as shown in FIGS. 3, 4 and 5, which also are disposed in notches in the vertical edges of a pair of parallel vertical metal plates 11 (FIG. 5) that are welded to the adjacent flange of the post. Pivotally mounted on the ends of each pin are fingers 12 for supporting horizontal drill pipe 13, each pair of fingers being rigidly connected at their far ends by a cross bar 14. Each of these cross bars normally bears against the adjoining side of the adjacent post 6. All of the fingers at each post are disposed in an inclined or sloping position parallel to one another and to the underlying sloping cross beam 7. The lower ends of the fingers extend a short distance beyond pivot pins 10 and each pair is provided between them with rollers 15 mounted on stub shafts 16 projecting toward each other.

Movable up and down each post 3 is a cam member, preferably in the form of a dolly 18 provided with wheels that roll against the opposite side of the outer flange of the post. The dolly has parallel vertical side plates 19 that straddle the outer portion of the post and that are connected outwardly of the post by upper and lower angle bars 20. The side plates are provided with a pair of stub shafts 21 projecting toward each other and supporting wheels 22 that roll against the inner surface of the outer flange of the post. Engaging the outer surface of the flange is a vertical wheel 23 rotatable around a shaft 24 mounted in the side plates of the dolly. At the top and bottom of the dolly there is a stub shaft 25 projecting toward the post and carrying a wheel 26 between two vertical angle irons 27 welded to the outer surface of the post. This wheel and the angle irons prevent lateral movement of the dolly as it travels up and down the post.

To move the dolly up and down, a nut 29 is bolted to one side of it and is threaded on a vertical screw 30 that is rotatably mounted at its upper end in a bearing 31 (FIG. 3) projecting from the post. The lower end of the screw is rotatably mounted in a speed reducer 32, which is driven by a horizontal shaft 33 extending lengthwise of the rack. One end of the shaft is driven by a suitable reversible motor 34, such as a hydraulic motor connected to it. Whenever this motor is operated, the vertical screws will move the dollies either up or down the posts, depending upon which direction the motor is operated.

Welded to the inner edges of the side plates of each of the dollies is a vertical cam plate 35, from the upper and lower ends of which inclined extensions 36 extend outwardly. When the dollies are in their upper positions, as shown in FIG. 3, these cam plates overlie the rollers 15 on the lower ends of fingers 12. When the dollies are moved downwardly by screws 30, the cam plates will press down on the uppermost row of rollers 15 and thereby depress the lower ends of the upper fingers, which causes their upper ends to swing upwardly. As the dollies continue to move downwardly, as shown in FIG. 4, they cause the upper ends of the fingers in each row to be swung upwardly in succession until all of them are raised. As a downwardly moving dolly leaves a raised pair of fingers, they remain raised because their upper ends are supported by the pair immediately below. One way of doing this is to connect each pair of fingers with a depending cross bar 37 that will rest on the underlying pair of raised fingers. As shown in FIG. 3, before the fingers are raised, their upper ends are in such a position that they will be directly beneath a pipestand 13 that is carried out of the derrick to be placed in the pipe rack. On the other hand, raising all of the fingers moves their upper ends away from that position so that when a pipestand is lowered it can pass all of the fingers and be deposited on the upper ends of the inclined beams 7 connecting the long and short posts.

In order to transfer pipestands from the derrick to the rack and vice versa, a pair of legs 40 are disposed close to the side of the rack where posts 6 are located, as shown in FIGS. 1, 2 and 3. The lower ends of these legs are pivotally mounted on horizontal axes in pedestal bearings 41, and the upper ends of the legs are tied together by a link 42 pivotally connected to them. Extending horizontally from the upper end of each leg toward the pipe rack is a short arm 43, on the free end of which there is a concave roller 44 for supporting a pipestand. These arms can be swung toward and away from the derrick by means of a fluid pressure cylinder 45 pivotally connected to one of the legs and to the floor or deck.

When the transfer arms deposit a pipestand on the upper ends of the inclined beams 7 of the pipe rack while all of the fingers 12 are raised, the pipestand does not roll down the beams because that is prevented by conveyor screws 47 located beside the fingers. These screws are movable vertically with the dollies, there being two screws connected with the central dolly and one screw for each of the end dollies. As shown in FIG. 3, the screws are inclined to the same extent as beams 7 and the fingers when the latter are in their lower position. The lower end of each screw is rotatably mounted in a framework 48 secured to one side of a dolly as shown best in FIG. 5. The screws are driven from their lower ends intermittently, and the screws and their flights are so arranged that they can engage the sides of pipestands resting on the inclined beams 7 or the highest unraised row of fingers and either convey the pipe up the sloping fingers or beams 7 or control their rolling down those members. Thus, when a pipestand is deposited upon the upper ends of the inclined beams it engages the upper ends of the conveyor screw fiights. The screws are then turned one revolution, which moves the pipestand down the slope just far enough to permit the following pipestand to be deposited on the upper ends of the beams. Then the screws are rotated again to move both pipestands down the slope far enough to accommodate a third pipestand at the upper ends of the beams. This is continued until the beams support a row of pipestands extending from their lower ends to their upper ends.

As soon as the inclined beams 7 in the pipe rack have received a row of pipestands, the vertical traverse screws 30 are rotated to raise dollies 18 just far enough to permit the raised fingers in the lower row to swing down across the underlying row of pipestands. The conveyor screws were moved upwardly with the dollies at the same time to release the conveyor screws from the row of pipestands and to position them for conveying pipestands down along the top of the lowest row of fingers. For best results, the bottom of each finger is provided with a series of recesses 50 that fit over the pipestands below them and keep them separated. As each row of fingers is filled with pipestands, the dollies are raised so that the next row can be lowered and filled. This continues until all of the pipe has been removed from the well.

In going back into the well, the conveyor screws engage the uppermost row of pipestands in the rack and are operated to convey them up to the upper ends of the screws in succession, so that the upper pipestand can be picked up by the transfer arms and carried to the derrick. As soon as all of the pipe has been removed from a row of fingers, the dollies are moved down far enough to raise the fingers that were just unloaded and to position the screws for moving the next row of pipe up to the transfer arms, as indicated in FIG. 4.

The preferred way of rotating the conveyor screws intermittently for the purpose just explained is by means of a double acting cylinder 51 rigidly mounted in framework 48 at one side of the conveyor screw, as shown in FIG. 5. It contains a piston attached to the inner ends of piston rods 52 that project from the opposite ends of the cylinder. The outer ends of the piston rods are attached to the opposite ends of a pair of parallel sprocket chains 53. These chains extend around sprockets 54 rotatably mounted in the outer end of the framework and the chains also extend around sprockets 55 rigidly mounted on a collar 56 that is rotatably mounted on the conveyor screw. This collar is secured to a disc 57 that supports a ratchet ring 58 provided in its inner surface with circumferentially spaced recesses 59, as shown in FIG. 6. These recesses are formed to receive either end of each of a pair of pawls 60.

The pawls are pivotally mounted in the opposite ends of a bracket 62 secured to a ring 63 that encircles a bushing 64 keyed to the shaft of the conveyor screw. The ring can be held in either of two positions on the bushing, which is provided with two circumferentially spaced sockets 65. A spring-pressed, but manually retractable, pin 67 extends into the ring and into one of these sockets. Also attached to ring 63 are two diametrically opposite lugs 68, each of which is connected by coil springs 69 to the adjacent ends of the two pawls. It will be seen in FIG. 6 that when pin 67 is in the right-hand socket as shown, the lower end of the right-hand pawl and the upper end of the other pawl will be pulled by the springs toward the axis of the shaft. When the pin is in the other socket, the springs will swing the pawls in the opposite direction. With this ratchet arrangement, when the sprocket chains are pulled in one direction by delivering fluid pressure to one end of cylinder 51 and exhausting it from the other, the ratchet ring 58 will push against the pawls and cause them to rotate the conveyor screw, but when the sprocket chains are reversed by reversing the cylinder, the ratchet ring will slide across the pawls. The movement of the ratchet ring each time the sprocket chains are pulled in the first direction is such that the conveyor screw is turned one revolution.

With the pipe rack disclosed herein, a great many pipestands can be stored in a relatively narrow space. The rack remains in fixed position, so no space is required to permit it to be moved laterally during use as is the case with the rack shown in our copending application mentioned herein. No manual handling of the pipe in the rack is required. If the rack is on a ship, the pipe will not be disturbed by ship roll because the stands are securely held in place in the rack by the fingers. The pipestands can be quickly uncovered or covered by simply running the dollies down or up. Movement toward or from the pickup station at the upper end of the fingers is accomplished by the conveyor screws, the operation of which can be timed with the movement of arms 43 that transfer the pipe between a strongback 71 (FIG. 2) and the rack. The strongback is pivotally supported by the outer end of a pivoted boom 72 that swings in a vertical plane so that clamps 73 on the ends of the strongback can engage a vertical pipestand in the derrick and lower it to horizontal position as shown.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A pipe rack comprising a plurality of vertically spaced rows of longitudinally inclined fingers spaced laterally in each row, supporting means near one end of the fingers pivotally supporting them on transverse horizontal axes, the fingers sloping upwardly from said supporting means and also projecting in the opposite direction from said axes, vertically movable cam members at the lower ends of the fingers provided with vertical surfaces overlying said lower ends when said members are in their uppermost position, reversible means for moving the cam members downwardly step by step to cause them to depress the lower ends of the fingers and thereby raise their upper ends, the upper ends of the fingers in the row immediately below the lowest row of raised fingers being positioned to receive a horizontal pipe lowered onto them, inclined conveyor screws spaced laterally from said fingers and movable vertically with said cam members, the screws sloping like the fingers, and means at the lower ends of the screws for driving them intermittently to convey said pipe step by step downwardly along the fingers supporting it, said cam members being movable upwardly by said reversible means far enough to permit the lowest row of raised fingers to swing down over the pipes directly below ready to receive and support a row of pipes.

2. A pipe rack according to claim 1, in which the bottoms of the fingers have recesses therein for receiving the pipes directly below them.

3. A pipe rack according to claim 1, in which each raised finger is supported in raised positions by the underlying finger as said cam means moves downwardly away from the lower end of the first-mentioned finger.

4. A pipe rack according to claim 1, in which said supporting means are posts provided with vertically spaced pivots for said fingers.

5. A pipe rack according to claim 1, in which said reversible means include vertical screws, a nut threaded on each vertical screw and rigidly connected with the adjoining cam member, and means for rotating the vertical screws in either direction.

6. A pipe rack according to claim 1, including means attached to the adjacent cam member for supporting each conveyor screw, and said screw-driving means being carried by said screw-supporting means.

7. A pipe rack according to claim 6, in which said screw-driving means include a fluid pressure cylinder for each conveyor screw, a piston therein, a ratchet drive for the conveyor screw, and means operatively connecting the piston with the ratchet drive to operate it as the piston moves back and forth in the cylinder.

8. A pipe rack according to claim 7, in which the means connecting said piston with said ratchet drive include a sprocket rotatably mounted on the adjoining conveyor screw, a chain extending around the sprocket with its ends connected to opposite ends of the piston, and a ratchet ring rotatably mounted on the conveyor screw and rigidly connected with said sprocket for rotation thereby.

9. A pipe rack according to claim 1, including posts at the upper ends of said fingers, and means on the upper ends of the fingers for engaging the sides of the posts to support the sloping fingers in their lower position.

10. A pipe rack according to claim 1, in which each of said cam members is a dolly, and said supporting means include a post at the lower ends of the fingers on which the dolly travels up and down.

* * * * *